US005260747A

United States Patent [19]

Uwagawa et al.

[11] Patent Number: 5,260,747

[45] Date of Patent: Nov. 9, 1993

[54] DEVELOPING APPARATUS HAVING CAPABILITY OF RECOVERING DEVELOPING POWDER

[75] Inventors: Seiko Uwagawa, Kita-Katsuragi; Yukihisa Imaue, Ikoma, both of Japan

[73] Assignee: Sharp Kabushiki Kaisha, Osaka, Japan

[21] Appl. No.: 982,187

[22] Filed: Nov. 25, 1992

[30] Foreign Application Priority Data

Nov. 29, 1991 [JP] Japan ..... 3-316375

[51] Int. Cl.[5] ..... G03G 21/00

[52] U.S. Cl. ..... 355/246; 355/204; 355/208; 355/215

[58] Field of Search ..... 355/245, 246, 260, 204, 355/203, 208, 215, 219; 361/225; 222/DIG. 1

[56] References Cited

U.S. PATENT DOCUMENTS 4,358,196 11/1982 Mugrauer ..... 355/246
4,439,034 3/1984 Daniels ..... 118/658
4,625,895 12/1986 Tsukano et al. ..... 358/260 X
4,629,309 12/1986 Tsukano et al. ..... 353/245
4,724,459 2/1988 Ford ..... 355/245 X
4,891,671 1/1990 Iwamasa ..... 355/245
4,891,673 1/1990 Buell ..... 355/245
4,932,355 6/1990 Neufeld ..... 355/246
5,025,289 6/1991 Guslits et al. ..... 355/260 X
5,095,338 3/1992 Hayes, Jr. et al. ..... 355/246

*Primary Examiner*—A. T. Grimley
*Assistant Examiner*—Matthew S. Smith
*Attorney, Agent, or Firm*—David G. Conlin; George W. Neuner

[57] ABSTRACT

A developing apparatus includes a developing bath for storing developing powder, a developing roller rotatably disposed inside of the developing bath, a bias circuit for applying a bias voltage for adjusting an image quality to the developing roller, a unit for recovering the developing powder from the developing bath, and a device for controlling operation of the bias circuit such that the bias circuit applies a bias voltage higher than a bias voltage for developing to the developing roller when recovering the developing powder.

5 Claims, 6 Drawing Sheets

DEVELOPING APPARATUS HAVING CAPABILITY OF RECOVERING DEVELOPING POWDER

BACKGROUND OF THE INVENTION

1. Field of the Invention

The present invention relates to a developing apparatus, and more particularly to the developing apparatus which provides a capability of preventing the inside and the outside of the developing apparatus itself from being contaminated by the developing powder when the exhausted developing powder is recovered from the developing apparatus in an electronic photography type copying machine and printer.

2. Description of the Related Art

The inventors of the present application know that the developing powder used in an image forming apparatus of an electronic photography type has been weary after several thousands to ten thousands of papers are developed. The worn-out developing powder causes the quality of the developed image to be degraded. And it may be splashed inside and outside of the apparatus, thereby contaminating the inside and the outside of the apparatus.

To overcome this shortcoming, it is necessary to exchange the worn-out or exhausted developing powder. As means for recovering the exhausted developing powder, the inventors know the traditionally proposed mechanisms described below.

As a first known mechanism, a recovery vessel is located in the circulating path of a developing bath so that the developing powder left in the bottom part of the developing bath may be recovered by means of a magnet. As a transformation of the first known mechanism, the magnet is arranged to travel as it is attracting the exhausted developing powder.

As a second known mechanism, a concave catch pan* is located in the lower part of the developing bath so that the developing powder may be received by the catch pan* and then is recovered into the recovery vessel.

As a third known mechanism, a shutter provided on the bottom of the developing bath is made open over the overall length of the circulating part of the developing powder. From the open shutter, the exhausted powder is recovered into a recovery vessel detachably mounted under the bottom of the developing bath.

The foregoing known mechanisms have the following disadvantages. The first known mechanism may cause the splash or the drop of the developing powder resulting from the rotation of a developing roller. The second known mechanism is arranged to temporarily receive the developing powder in the catch pan. When the powder drops into the catch pan, the powder may be splashed into the inside of the apparatus itself, thereby contaminating the inside of the apparatus itself. The third known mechanism needs a user to open the shutter horizontally by his or her hand when the exhausted powder is recovered. It means that this mechanism needs an additional troublesome operation. Further, the developing powder fitted to the shutter may drop around it. This results in contaminating the outside of the apparatus itself.

SUMMARY OF THE INVENTION

It is an object of the present invention to provide a developing apparatus which provides a capability of recovering exhausted developing powder without having to contaminating the inside and the outside of the developing apparatus itself.

In carrying out the object, a developing apparatus includes a developing bath for storing developing powder; a developing roller rotatably disposed inside of the developing bath; a bias circuit for applying a bias voltage for adjusting an image quality to the developing roller; means for recovering the developing powder from the developing bath; and means for controlling operation of the bias circuit such that the bias circuit applies a bias voltage higher than a bias voltage for developing to the developing roller when recovering the developing powder.

In operation, to exchange the exhausted developing powder, the developing powder recovering mechanism is operated to recover the developing powder. At a time, a switching signal is output to the bias circuit in a manner to change the bias voltage from the voltage $V_1$ for the developing to the larger voltage $V_2$ dedicated to the recovery. That is, while the exhausted powder is recovered, the bias voltage $V_2$ applied onto the developing roller is larger than the bias voltage $V_1$ for the developing. As such, the developing powder charged by the larger voltage $V_2$ is more vigorously attracted by the developing roller than the developing powder charged by the voltage $V_1$ for the developing. When the developing roller is rotating, therefore, no substantial splash or drop of the developing powder from the developing bath takes place.

Hence, the developing powder does not contaminate the inside and the outside of the developing apparatus itself and need a troublesome cleaning work after the developing powder is recovered. This leads to enhancing the efficiency of the recovering operation.

Further objects and advantages of the present invention will be apparent from the following description of the preferred embodiment of the invention as illustrated in the accompanying drawings.

DESCRIPTION OF THE PREFERRED EMBODIMENTS

Figure 1:
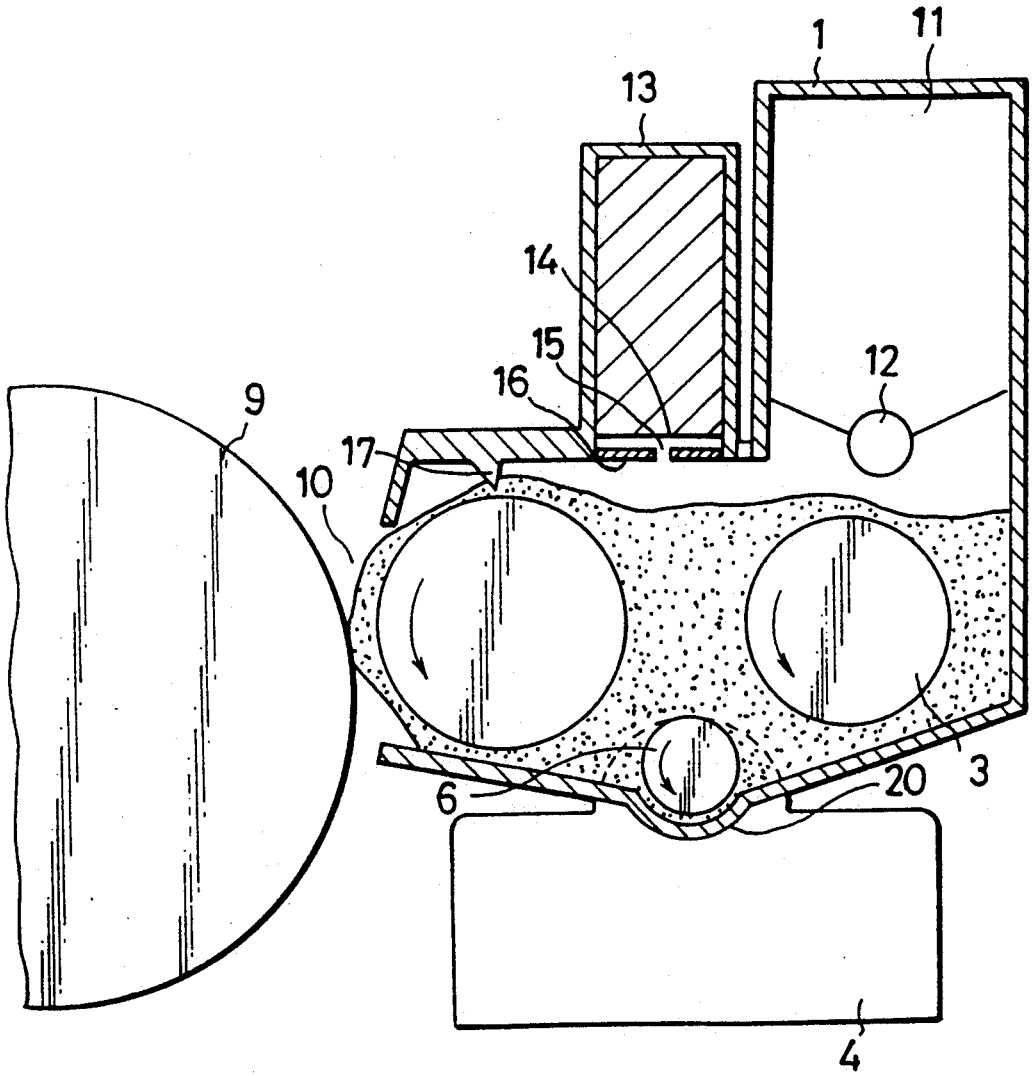
FIG. 1 is a side view showing a developing apparatus according to an embodiment of the invention.
Figure 2:
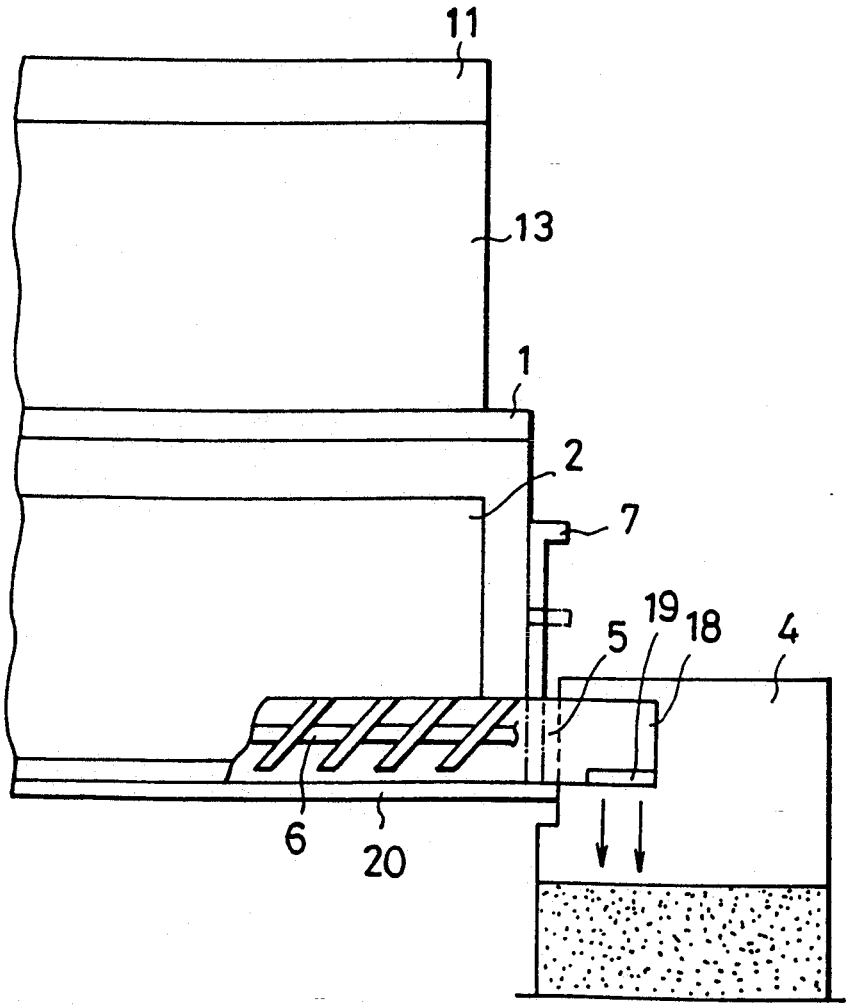
FIG. 2 is a side view showing a mechanism for recovering developing powder included in the developing apparatus shown in FIG. 1.
Figure 3:
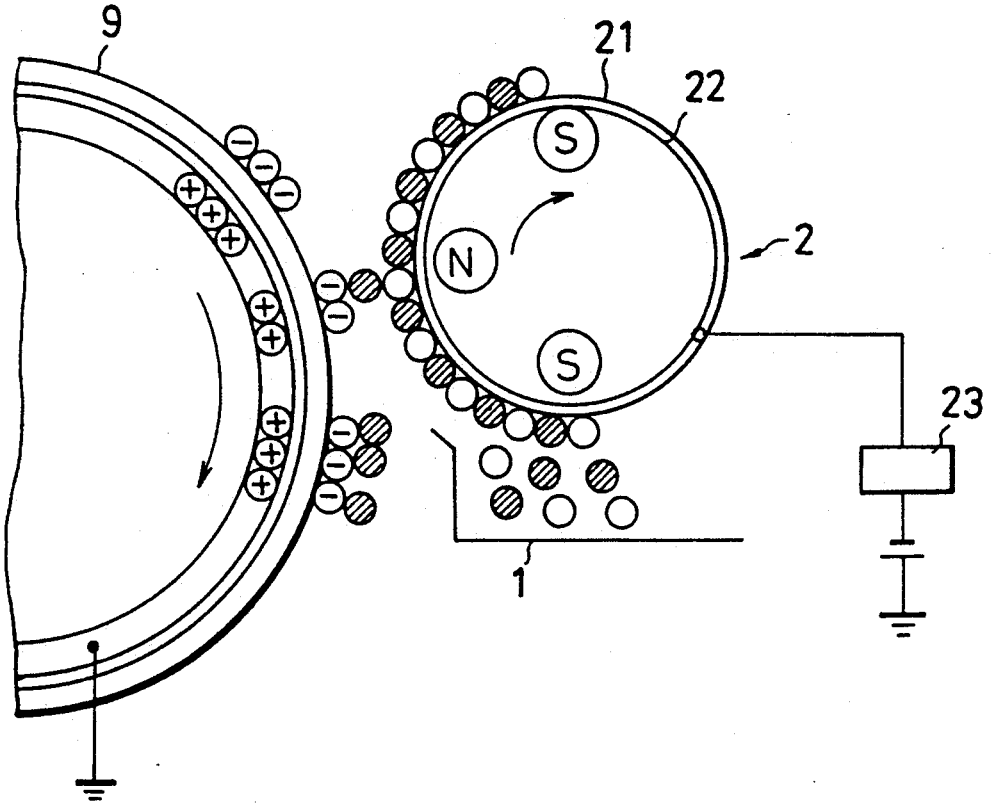
FIG. 3 is a view showing how developing powder moves between a developing roller and a photosensitive body in the developing apparatus.
Figure 4:
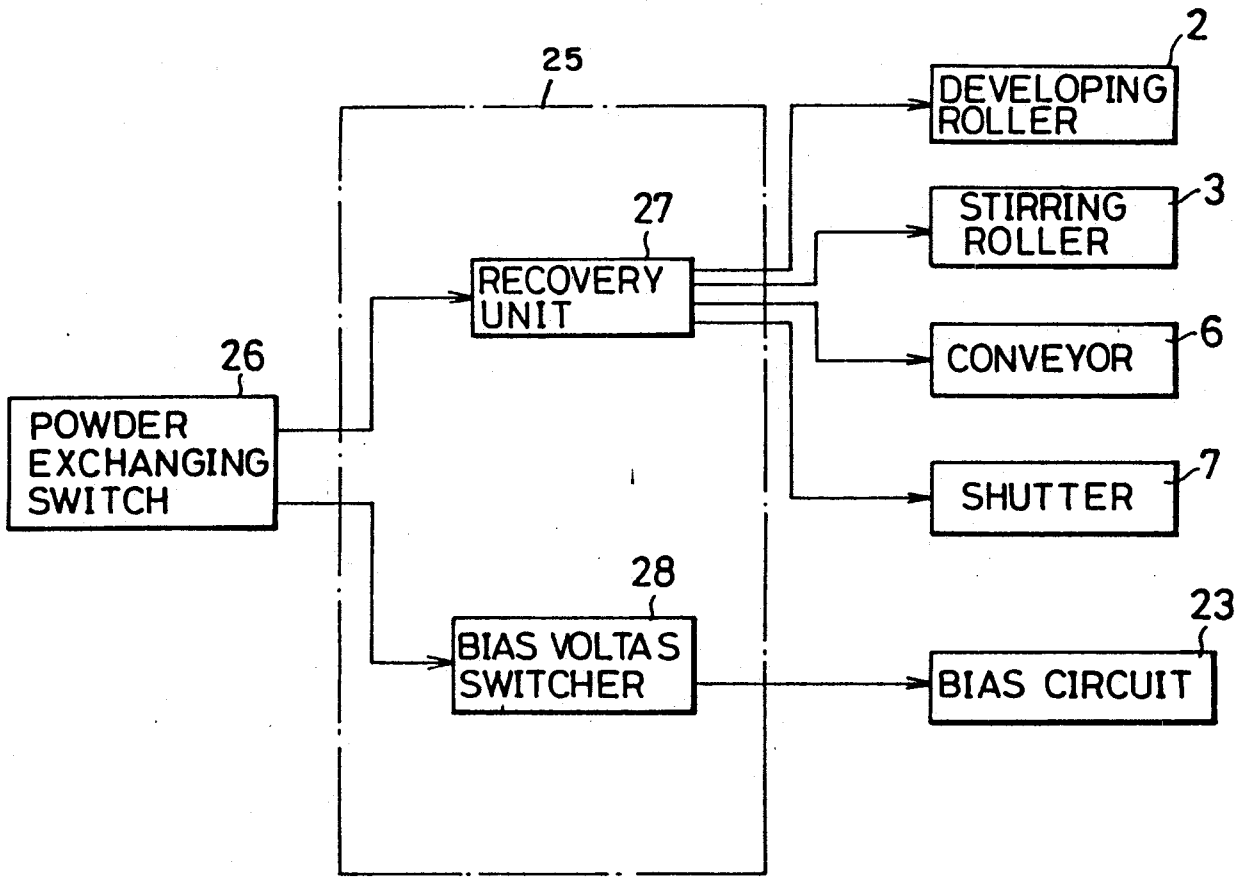
FIG. 4 is a block diagram showing a developing powder control unit included in the developing apparatus.

Herein, the description will be directed to a developing apparatus according to an embodiment of the invention as referring to the drawings, in which FIG. 1 is a sectional view showing the developing apparatus, FIG. 2 is a side view showing a mechanism for recovering developing powder, FIG. 3 is a view showing the motion of the developing powder between a developing roller and a photosensitive body, and FIG. 4 is a block diagram showing a control unit for recovering the developing powder.

As shown in FIGS. 1 and 2, a numeral 1 denotes a developing bath in which a developing roller 2 and a stirring roller 3 are rotatably fitted. A numeral 4 denotes a recovery vessel attached on one end of the developing bath 1. A numeral 5 denotes an exhaust outlet formed between the developing bath 1 and the recovery vessel 4.

A mechanism for recovering the developing powder from the developing bath 1 to the recovery vessel 4 is arranged to have a conveyor 6 and a shutter 7. The conveyor 6 is located under the developing bath 1 and serves to convey the developing powder to the recovery vessel 4. The shutter 7 operates to open or close the exhaust outlet 5.

The developing bath 1 includes an opening 10 axially formed along the side facing to a photosensitive body 9. On the side of the opening 10, the developing roller 2 is located. At the opposite side to the roller 2, the stirring roller 3 is located. Arrows shown in FIG. 2 indicate the rotating directions.

A numeral 11 denotes a toner feeding bath attached above the stirring roller 3. A numeral 12 denotes a toner feeding roller rotatably provided at a communication port between the toner feeding bath 11 and the developing bath. A numeral 13 denotes a developing powder cartridge detachably mounted above the developing roller 2 and the stirring roller 3 and sealed by a sealing member 14.

A numeral 15 denotes a toner feeding inlet between the cartridge 13 and the developing bath 1. A numeral 16 denotes an electric shutter provided at the powder feeding inlet 15 so as to open or close the inlet 15. A numeral 17 denotes a doctor.

Turning to FIG. 2, the exhaust outlet 5 is formed on the lower portion of the end perpendicular to the axial direction of the developing bath 1. The recovery vessel 4 is located as opposed to the exhaust outlet 5. An numeral 18 denotes an exhausting cylinder which is fitted into the upper side of the recovery vessel 4. The exhausting cylinder 18 is arranged so that one end is closed inside of the recovery vessel 4, a drop outlet 19 is formed on the lower surface, and the other end is connected to the exhaust outlet 5 of the developing bath 1.

The conveyor 6 consists of a conveying screw rotatably supported by the developing bath 1. The conveying screw operates to rotate in the same direction of the developing roller 2 and the stirring roller 3. The conveying screw is located within an arc groove 20 formed on the bottom of the developing bath 1 and projected downwardly. The exhaust outlet 5 is opened toward one end of the groove 20.

The shutter 7 is located between the exhaust outlet 5 of the developing bath 1 and the exhausting cylinder 18 of the recovery vessel 4 so that the shutter 7 may be moved vertically along the outer wall of the developing bath 1 as being driven by a motor.

The developing roller 2 consists of a non-magnetic sleeve 21 and a magnet body 22. The non-magnet sleeve 21 is rotatable and conductive. The magnet body 22 is fixed inside of the sleeve 21. A negative bias voltage is applied from the bias circuit 23 to the sleeve 21 so that the frictional charge between the carrier and the toner of the developing powder may cause the sleeve 21 to attract the toner.

At a time, as shown in FIG. 3, a bias voltage $V_1$ of $-200$ V is applied to the developing roller 2 for preventing the toner from being attracted by the residual voltage of the bright area of the photosensitive body 9 after exposure.

When recovering the developing powder, a larger bias voltage $V_2$ than the bias voltage $V_1$ for the developing is applied to the developing roller 2. For switching the bias voltages, a recovery control unit 25 is provided for controlling the bias circuit 23.

As shown in FIG. 4, the recovery control unit 25 consists of a microcomputer. The microcomputer includes a developing powder exchange switch 26, a recovery unit 27 and a bias voltage switcher 28. When the switch 26 is turned on or set to a simulation mode for exchanging the developing powder, the recovery unit 27 operates the developing powder recovery mechanism. When recovering the developing powder, the bias voltage switcher 28 serves to switch the bias voltage applied to the developing roller 2 from the bias voltage $V_1$ for the developing into the larger voltage $V_2$ than the bias voltage $V_1$ ($|V_1| < |V_2|$).

After recovering the developing powder, the recovery control unit 25 operates to close the shutter 7 for closing the exhaust outlet 5, open the electric shutter 16 of the powder cartridge 13 for charging the powder into the developing bath 1.

When forming a normal image, the developing roller 2, the stirring roller 3 and the conveyor 6 are all driven so that the developing roller 2 may develop an image on the photosensitive body as the developing powder is being stirred in the developing bath 2. At this time, the bias circuit 23 is applying the bias voltage $V_1$ to the developing roller 2. Since the shutter 7 closes the exhaust outlet 5, no developing powder conveyed by the conveyor 6 is exhausted out of the exhaust outlet 5, so that the developing powder left in the bottom of the developing bath 1 may be stirred.

When the developing powder is exhausted, the developing powder cartridge 13 is mounted at the top of the developing bath 1 and the sealing member 14 is stripped. At this time, the electric shutter 16 is closed.

Then, turn on the powder exchange switch 26. With the switch 26 being on, the powder recovery control unit 25 serves to move the shutter 7 upward for opening the exhaust outlet 5. At a time when the developing roller 2, the stirring roller 3 and the conveyor 6 are all driven, the bias voltage switcher 28 supplies a switching signal to the bias circuit 23 so as to change the bias voltage from $V_1$ to $V_2$.

The developing powder in the developing bath 1 is collected in the groove 20 under the developing bath 1 by means of the developing roller 2 and the stirring roller 3. Then, the developing powder is conveyed to the exhaust outlet 5 through the effect of the conveyor. The developing powder is fed from the exhaust outlet 5 to the exhausting cylinder 18 from which the power drops into the recovery vessel 4 through the drop outlet 19.

After the recovery of the developing powder into the recovery vessel 4 is terminated as a result of driving the developing roller 2, the stirring roller 3 and the conveyor 6 for a certain length of time, the shutter 7 is moved downwardly so as to close the exhaust outlet 5. Then, the electric shutter 16 of the powder feeding outlet 15 is made open so that the new developing powder is fed from the cartridge 13 into the developing bath 1.

While the developing powder is being recovered, the larger bias voltage $V_2$ than the voltage $V_1$ for the developing is applied onto the developing roller 2. As such, the toner charged by a larger voltage is more vigorously attracted on the developing roller 2. The rotation of the developing roller 2 does not bring about the drop of the developing powder or the splash of the toner from the developing bath 1.

The prevention of the powder drop and the toner splash results in preventing the apparatus from being contaminated, thereby eliminating the troublesome cleaning operation after recovering the powder. This leads to enhancing the efficiency of the recovering operation.

This recovery arrangement provides a capability of automatically performing a series of operations from the recovery of exhausted developing powder into the charge of the new developing powder. The known recovery operations need a troublesome operation to be done by a maintenance clerk. This work is troublesome to the user. On the other hand, the recovery operations of this embodiment make it possible for a user to do the recovering operation by himself with ease. In addition, this recovering operation can suppress the powder fitted to the user's body to a minimum.

Further, when forming an image, the conveyor 6 operates as an auxiliary stirring roller. This results in enhancing the stirring characteristic of the developing powder and completely removing the developing powder left in the bottom of the developing bath 1 which does not make contribution to the actual developing. This leads to prolonging the life of the developing powder and making the quality of the image more stable.

Figure 5:
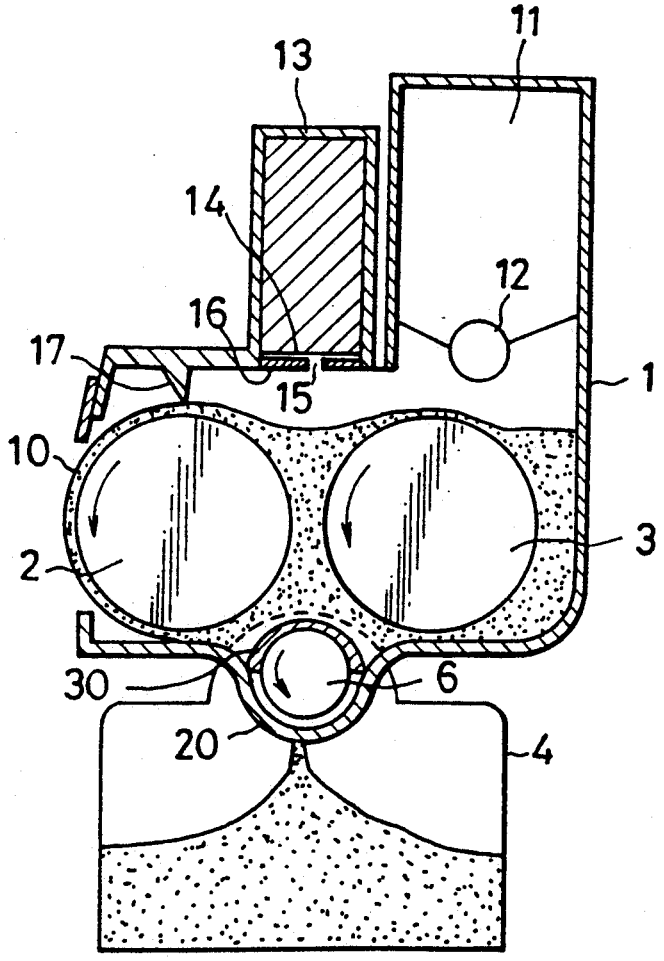
FIG. 5 is a view showing a developing apparatus having another mechanism for recovering developing powder.
Figure 6:
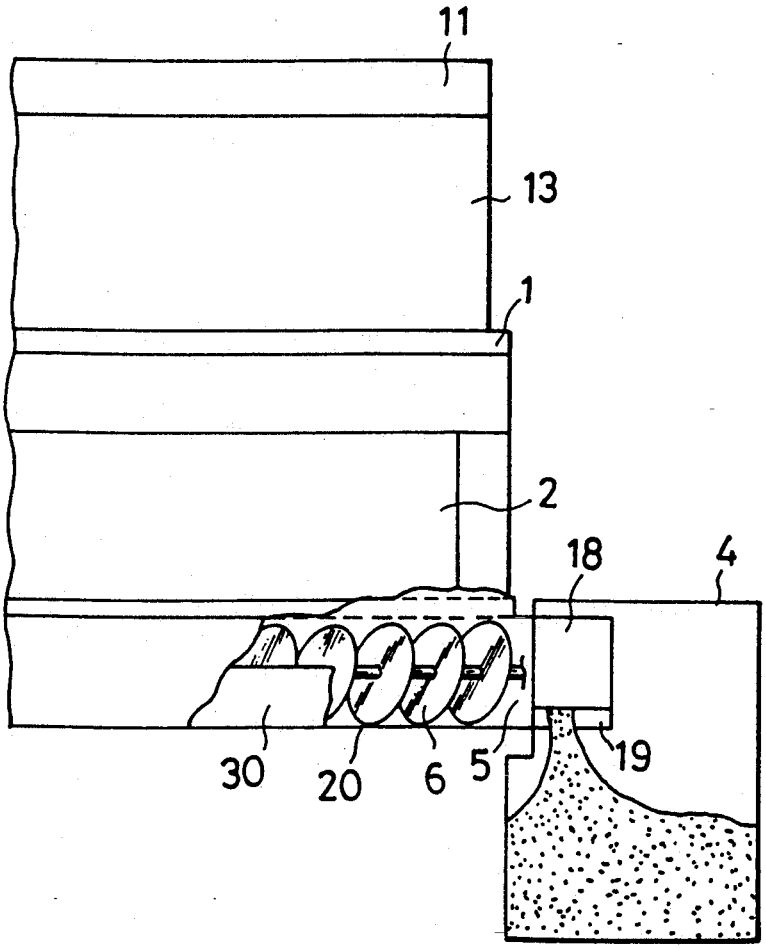
FIG. 6 is a side view showing the developing apparatus shown in FIG. 5.

In place of the shutter 7, as shown in FIGS. 5 and 6, a covering unit 30 may be provided so as to expose or conceal the conveyor 6 into or from the developing roller 2. When exchanging the developing powder, the developing roller 2, the stirring roller 3 and the conveyor 6 are driven and the covering unit 30 is operated to make the conveyor 6 exposed.

As shown, the covering unit 30 is made of an elongated plate in semicircular section, which is rotated around the screw. The covering unit 30 serves to cover the upper half of the overall length of the conveyor 6 for screening the conveyor 6 from the developing powder. The covering unit 30 serves to rotate 180 degrees so that it may cover the lower half of the conveyor 6. In this state, the conveyor 6 may be exposed into the developing bath 1 so that the developing powder may be conveyable.

Many widely different embodiments of the present invention may be constructed without departing from the spirit and scope of the present invention. It should be understood that the present invention is not limited to the specific embodiments described in the specification, except as defined in the appended claims.

What is claimed is:

1. A developing apparatus comprising:

a developing bath for storing developing powder;

a developing roller rotatably disposed inside of said developing bath;

a bias circuit for applying a bias voltage for adjusting an image quality to said developing roller;

means for recovering the developing powder from said developing bath; and means for controlling operation of said bias circuit such that said bias circuit applies a bias voltage higher than a bias voltage for developing to said developing roller when recovering the developing powder.

2. A developing apparatus as claimed in claim 1, wherein said controlling means includes a bias voltage switcher for supplying a signal for switching the bias voltage for developing to the high bias voltage to said bias circuit when recovering the developing powder.

3. A developing apparatus as claimed in claim 1, wherein said recovering means includes an exhaust outlet formed between said developing bath and a recovery vessel for recovering the developing powder, means for conveying the developing powder to said recovery vessel from said developing bath, said conveying means being located at a bottom portion of said developing bath, and a shutter for opening or closing said exhaust outlet.

4. A developing apparatus as claimed in claim 1, wherein said recovering means includes an exhaust outlet formed between said developing bath and a recovery vessel for recovering the developing powder, means for conveying the developing powder to said recovery vessel from said developing bath, said conveying means being located at a bottom portion of said developing bath, and covering means for covering an upper part of said conveying means when developing and for exposing said upper part of said conveying means when recovering the developing powder.

5. A developing apparatus as claimed in claim 4, wherein said covering means is made of an elongated plate.

* * * * *